United States Patent [19]

Phillips

[11] Patent Number: 4,791,736

[45] Date of Patent: Dec. 20, 1988

[54] SKI BOOT ORTHOTIC

[76] Inventor: Kevin Phillips, 1018 Clinton St., Philadelphia, Pa. 19107

[21] Appl. No.: 67,020

[22] Filed: Jun. 26, 1987

[51] Int. Cl.[4] ..... A43B 5/04; A43B 13/38; A43B 7/14

[52] U.S. Cl. ..... 36/117; 36/43; 36/88; 36/91; 128/586; 128/615; 12/142 P

[58] Field of Search ..... 36/43, 44, 88, 91, 117; 128/586, 615, 614, 581; 12/142 P, 145 N; 264/223

[56] References Cited

U.S. PATENT DOCUMENTS

| | | | |
|---|---|---|---|
| 2,349,374 | 5/1944 | Pym | 36/DIG. 2 |
| 3,426,455 | 2/1969 | Drago | 36/44 |
| 4,232,457 | 11/1980 | Mosher | 36/44 |
| 4,314,411 | 2/1982 | Hanson | 36/91 X |
| 4,338,734 | 7/1982 | Schwartz | 36/44 |
| 4,450,122 | 5/1984 | Gallina | 264/223 X |
| 4,470,782 | 9/1984 | Zimmerman, Jr. | 264/223 X |
| 4,567,617 | 2/1986 | Limbach | 36/117 X |
| 4,669,142 | 6/1987 | Meyer | 12/142 N |
| 4,686,993 | 8/1987 | Grumbine | 36/43 |
| 4,702,255 | 10/1987 | Schenkl | 36/91 X |

FOREIGN PATENT DOCUMENTS

| | | | |
|---|---|---|---|
| 61-255601 | 11/1986 | Japan | 36/43 |

*Primary Examiner*—James Kee Chi

*Attorney, Agent, or Firm*—Wegner & Bretschneider

[57] ABSTRACT

A custom-fit ski boot orthotic which efficiently transfers movement of the foot to the edges of the skis. The orthotic has a substantially rigid base plate attached to a rigid heel post. The base plate has an arch portion 20–40% shallower than the skier's actual arch which permits the limited movement necessary for foot comfort, without any significant loss in transfer efficiency. The base plate also has a heel cup portion to prevent heel roll. The orthotic of the present invention may be used as an insert or be built into the footbed of a ski boot.

14 Claims, 2 Drawing Sheets

SKI BOOT ORTHOTIC

BACKGROUND OF THE INVENTION

Typical inserts used for ski boots are designed to make the foot more comfortable while skiing. Such inserts are made of foam or cork and thus deform and cushion the foot. However, these inserts have a disadvantage, in that they do not efficiently transfer the movement of the foot to the boots and, hence, to the edges of the skis. As ski design technology becomes more advanced and skiers are capable of travelling at greater speeds, the ability to efficiently control the weighting of the ski's edges becomes more critical.

There is an additional difficulty caused by the fact that an individual's feet are rarely "perfect". Most people have some degree of pronation of supination to their feet. This misalignment is aggravated by the stresses imposed on a skier's body during skiing. While some people may compensate for foot misalignment by exaggerating other movements, this method of skiing is, at the very least, inefficient and, in the worst case, can cause serious bodily injury. For example, some people with pronated feet use excessive knee action or "travel" to weight the edges of their skis. This is both tiring to the skier and potentially harmful to the skier's knees.

Typical running shoe orthotics, while they may compensate for misalignment of the foot, are not useful for skiing. Running shoe orthotics are designed for an "active" foot, one that is constantly moving within the running shoe. Hence, a large degree of cushioning is required. Even running shoe orthotics with a hard base plate require overall cushioning. In contrast, ski boot orthotics must be designed for a more "static" foot. It is undesirable to have the foot move within the ski boot. Instead, substantially all of the movement of the foot should be transferred to the boot as efficiently as possible and, hence, to the ski and the ski edges.

SUMMARY OF THE INVENTION

It is, therefore, a primary object of the present invention to provide a ski boot orthotic free of the aforementioned and other such disadvantages.

It is a further object of the present invention to provide a ski boot orthotic which efficiently transfers energy from the skier's foot to the edges of the ski.

It is a further object of the present invention to accomplish the above objects while correcting misalignment of the skier's foot.

A ski boot orthotic in accordance with the present invention overcomes the above disadvantages by providing a custom-fit orthotic which efficiently transfers movement of the foot to the edges of the skis, having a substantially rigid base plate attached to a rigid heel post. The base plate has an arch portion 20–40% shallower than the skier's actual arch which permits the limited movement necessary for foot comfort, without any significant loss in transfer efficiency. The base plate also has a heel cup portion to prevent heel roll. The orthotic of the present invention may be used as an insert or be built into the footbed of a ski boot.

BRIEF DESCRIPTION OF THE DRAWINGS

The foregoing, and other objects will become apparent when reference is had to the following detailed description and the appended drawings wherein.

DETAILED DESCRIPTION OF THE PREFERRED EMBODIMENTS

Figure 1:
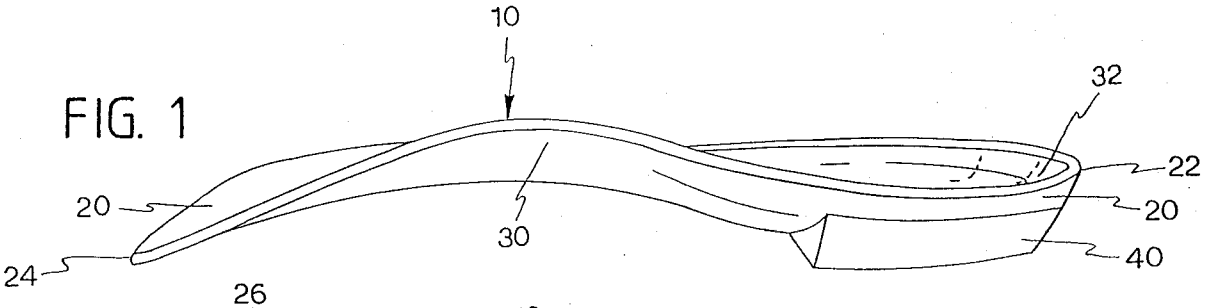
FIG. 1 is a perspective side view of a ski boot orthotic in accordance with a first preferred embodiment of the present invention.
Figure 2:
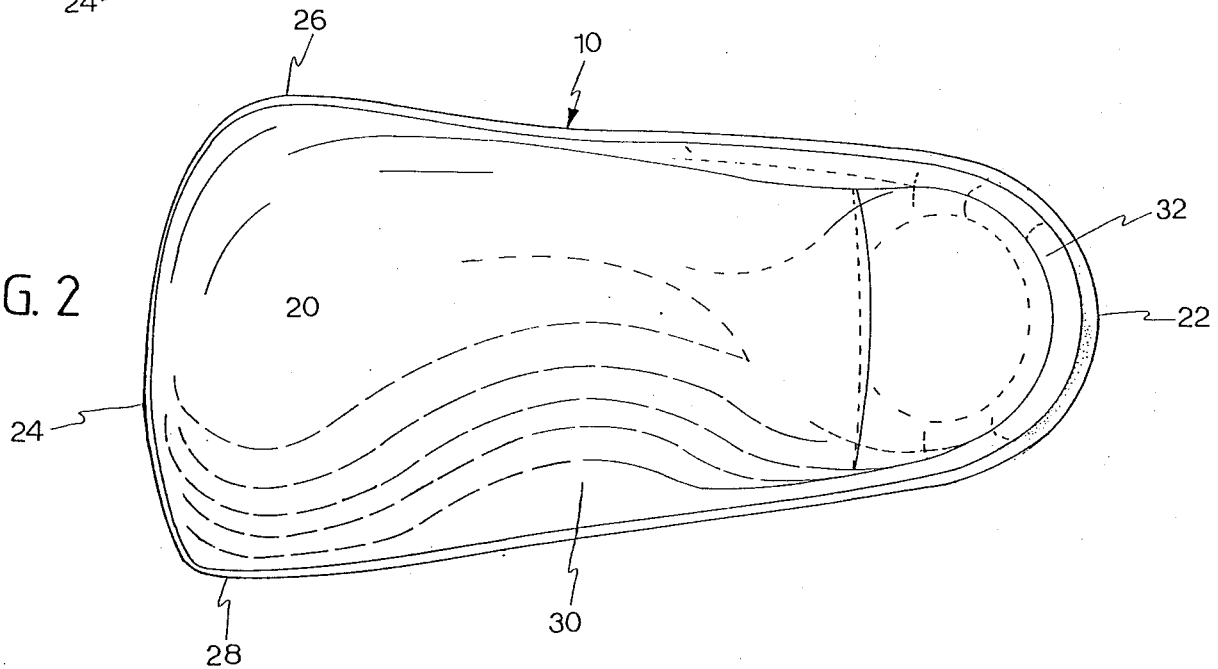
FIG. 2 is a plan view of the orthotic shown in FIG. 1.

A ski boot orthotic in accordance with a first embodiment of the present invention is illustrated in FIGS. 1 and 2 and generally designated as 10. In the Figures, like numerals will be used to represent like elements. Orthotic 10 includes base 20 and heel post 40. Heel post 40 provides a small amount of heel lift, as well as firmly trapping the orthotic within the ski boot.

Both the base and the heel post are formed of substantially rigid materials which aid in the efficient transfer of energy from the foot to the ski edges. The base is preferably formed of a polymeric polymer, such as a nitrile acrylic polymer, sold under the trade name ROHADUR, by Rabin of Darmstadt, West Germany. The heel post is preferably formed of a suitable rigid material such as a methylmethacrylate polymer or copolymer.

Base 20 preferably extends from posterior edge 22 adjacent the posterior of the heel to anterior edge 24 which terminates approximately beneath the ball of the foot, so as to provide proper support without interfering with the freedom of movement of the toes, which could cause discomfort. The angle of side edges 26,28 preferably increases 20–30% in width from heel to forefoot, depending on the individual's foot and the specific boot model.

Base 20 has arch portion 30, formed along the medial side portion of the base. The height of the arch is approximately 60–80% of the actual arch height of the individual skier, i.e., the arch portion is 20–40% shallower than the actual arch of the skier's foot. This difference permits the limited foot movement necessary for comfort, without significantly sacrificing transfer efficiency. Heel cup 32, formed in the posterior portion of base 20, reduces heel roll.

Figure 3:
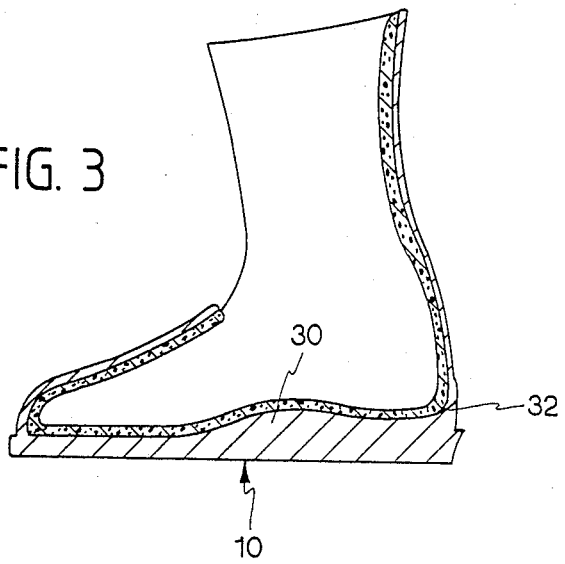
FIG. 3 is a side elevational view in cross-section of a ski boot orthotic built into the footbed of a ski boot in accordance with a second preferred embodiment of the present invention.

A second preferred embodiment of the present invention is illustrated in FIG. 3, in which the orthotic 10 is built into a ski boot. The orthotic is preferably integrally molded into the footbed portion of the outer shell of the boot. In this way, the orthotic is securely fixed in place, without any chance of slippage or movement within the boot. Alternatively, the orthotic may be formed separately and then placed within the bladder forming the interior padding of the ski boot.

A ski boot orthotic in accordance with the present invention is preferably formed by first taking an accurate impression of the skier's foot in the approximately non-weight-bearing position. Such an impression is preferably made by using a closed-cell impression foam, such as BIO-FOAM, made by Smithers Bio-Medical Systems of Kent, Ohio. A plaster mold of the foot is then made and the mold is examined to determine whatever misalignment may exist. The mold is leveled, using the fifth metatarsal-phalanges joint as a reference point, and plaster is added to eliminate the misalignment. The base material is then applied to the mold, the arch height being adjusted to be shallower than the actual arch height of the foot, as discussed above. The mold is removed and the heel post applied to the base. Both the base and the heel post are cut and ground to fit the specific boot model. Thus, the orthotic is custom-fit not only to the skier's foot, but to the skier's boots as well.

The foregoing is for illustrative purposes only. Modifications may be made, particularly with regard to size shape and arrangement of parts, within the scope of the invention as determined by the broad, general meaning of the terms in which the appended terms are expressed. For example, it is understood that the base could be formed of other materials, such as metal sheeting and the like.

I claim:

1. A custom fit ski boot orthotic device which eliminates foot misalignment and efficiently transfers energy from a skier's foot to the edges of a ski, said device comprising:

a base formed of a substantially rigid material, said base holding a skier's foot almost static within the ski boot;

an arch portion formed in said base, said arch portion shaped so as to be shallower than the skier's actual arch; and a heel support means attached to said base portion for providing a small amount of heel lift.

2. A device as in claim 1 wherein said arch portion is about 20–40% shallower than the skier's actual arch.

3. A device as in claim 1 wherein said base has an anterior edge terminating approximately under the ball of the skier's foot.

4. A device as in claim 1 wherein said base is formed of a polymeric material.

5. A device as in claim 4 wherein said material is a nitrile acrylic polymer.

6. A device as in claim 1 wherein said heel support means is formed of methylmethacrylate polymer or copolymer.

7. A device as in claim 1 wherein said base further includes a heel cup means formed in the posterior portion of said base for preventing heel roll.

8. A device as in claim 1, wherein said arch portion is shallower than the skier's actual arch by a predetermined amount.

9. A device as in claim 1, wherein said base is shaped to fit a specific boot model.

10. A ski boot which efficiently transfers energy from a skier's foot to the edges of the skis comprising:

a ski boot having a footbed portion; and orthotic means coupled to said footbed for holding a skier's foot essentially static within said ski boot and correcting any misalignment of the skier's foot, said orthotic means including a base formed of substantially rigid material, said base having an arch portion and a heel support portion, said arch portion shaped so as to be 20–40% shallower than the skier's actual arch.

11. A ski boot as in claim 10 wherein said arch portion is 20–40% shallower than the skier's actual arch.

12. A ski boot as in claim 10 wherein said base is formed of a nitrile acrylic polymer.

13. A ski boot as in claim 10 further comprising a ski boot shell and wherein said base is integrally molded with said shell.

14. A ski boot as in claim 10 further comprising a bladder-type cushion within said ski boot and wherein said base is fitted within said bladder.

* * * * *